US008902114B1

(12) United States Patent
West et al.

(10) Patent No.: US 8,902,114 B1
(45) Date of Patent: Dec. 2, 2014

(54) ANTI-JAM COGNITIVE BAVA ESA RADIATING ELEMENT INCORPORATING INTEGRATED Z-FAB TUNABLE FILTERS

(75) Inventors: James B. West, Cedar Rapids, IA (US); Modhwajih A. Elsallal, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 460 days.

(21) Appl. No.: 13/242,231

(22) Filed: Sep. 23, 2011

(51) Int. Cl.
*H01Q 13/00* (2006.01)

(52) U.S. Cl.
USPC ..... 343/767; 343/722

(58) Field of Classification Search
CPC .. H01Q 13/085; H01Q 13/103; H01Q 9/0442
USPC ..... 343/722, 767; 455/1
See application file for complete search history.

(56) References Cited

U.S. PATENT DOCUMENTS 5,486,832 A * 1/1996 Hulderman ..... 342/70
2008/0211726 A1* 9/2008 Elsallal et al. ..... 343/770
2008/0291983 A1* 11/2008 Myers ..... 375/219

OTHER PUBLICATIONS

U.S. Appl. No. 12/893,585, filed Sep. 29, 2010, ElSallal et al.
U.S. Appl. No. 12/893,648, filed Sep. 29, 2010, West et al.
U.S. Appl. No. 12/856,748, filed Aug. 16, 2010, Palandech et al.

* cited by examiner

*Primary Examiner* — Dieu H Duong
(74) *Attorney, Agent, or Firm* — Angel N. Gerdzhikov; Donna P. Suchy; Daniel M. Barbieri

(57) ABSTRACT

The present disclosure provides a radiating element, such as a Balanced Antipodal Tapered Slot Antenna (BAVA) radiating element having embedded circuitry which includes an integrated filter and functions as a port mismatch circuit for protecting a communication system implementing the radiating element from jammers. The embedded circuitry may provide a dynamically adjustable filter and/or a port mismatch circuit at the radiating element level which allows for center frequency tuning, provides selectivity and/or acts as an adaptive first line of defense layer for protecting sensitive radio and digital signal processing (DSP) physical layers of the communication system.

13 Claims, 6 Drawing Sheets

ANTI-JAM COGNITIVE BAVA ESA RADIATING ELEMENT INCORPORATING INTEGRATED Z-FAB TUNABLE FILTERS

FIELD OF THE INVENTION

The present invention relates to the field of antennas and more particularly to an anti-jam, cognitive Balanced Antipodal Vivaldi Antenna (BAVA) Electronically Scanned Array (ESA) radiating element incorporating integrated Z-FAB tunable filters.

BACKGROUND OF THE INVENTION

Ultra wideband (UWB) capability is a requirement for Electronic Warfare (EW) systems, Signals Intelligence (SIGNINT) systems, EW support, Electronic attack, EW self-protection, jamming systems and broadband communication systems. However, currently available UWB radiating elements are inherently vulnerable to off-band jammers.

Thus, it would be desirable to provide a solution which addresses the problems associated with currently available (ex. —traditional) technologies.

SUMMARY OF THE INVENTION

Accordingly an embodiment of the present disclosure is directed to a radiating element assembly, including: a radiating element, the radiating element including a substrate, the radiating element configured for radiating electromagnetic energy; circuitry, the circuitry being connected to the radiating element, the circuitry including a filter, the filter configured for being tuned to a radio frequency (RF), wherein the radiating element and circuitry are connected to a circuit card, the filter configured for being one of: connected to the radiating element at an input port of a feed structure of the radiating element or integrated within the substrate at a radiation throat area of the radiating element.

A further embodiment of the present disclosure is directed to a radiating element assembly, including: a Balanced Antipodal Vivaldi Antenna (BAVA) radiating element, the BAVA radiating element including a substrate, the BAVA radiating element configured for radiating electromagnetic energy; circuitry, the circuitry being connected to the BAVA radiating element, the circuitry including at least one filter, the at least one filter configured for being tuned to a radio frequency (RF), wherein the BAVA radiating element and circuitry are connected to a printed circuit board card, the at least one filter being integrated within the substrate at a radiation throat area of the BAVA radiating element.

A still further embodiment of the present disclosure is directed to a Balanced Antipodal Vivaldi Antenna (BAVA) array, including: a plurality of BAVA radiating element assemblies, each of the plurality of BAVA radiating element assemblies including a BAVA radiating element, each BAVA radiating element including a substrate, each of the plurality of BAVA radiating element assemblies configured for radiating electromagnetic energy, each of the plurality of BAVA radiating element assemblies including a circuit, each of the circuits being connected to the plurality of BAVA radiating elements, each of the circuits including at least one filter, the at least one filter configured for being tuned to a radio frequency (RF), each of the BAVA radiating elements and circuits being connected to printed circuit board cards, the filters being: connected to the radiating elements at input ports of feed structures of the radiating elements or integrated within the substrates at radiation throat areas of the radiating elements; and a parallel plate waveguide including a first plate and a second plate, the plurality of BAVA radiating element assemblies being connected to and between the first plate and second plate.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Ultra wideband (UWB) capability is a requirement for Electronic Warfare (EW) systems, Signals Intelligence (SIGNINT) systems, EW support, Electronic attack, EW self-protection, jamming systems and broadband communication systems. However, currently available UWB radiating elements implemented in such systems are inherently vulnerable to off-band jammers. Previous attempts to solve the above-referenced jammer susceptibility issues have involved the use of Digital Signal Processing (DSP) adaptive nulling to place a null in the jammer direction. However, such adaptive nulling solution has offered no provision for protecting the Radio Frequency (RF) transceiver and processing circuit (of the communication system in which the UWB radiating element(s) is/are implemented) in the transient time when the jammer is detected and the null is formed. Further, when implementing said adaptive nulling solution, system saturation and RF (ex.—digital) circuit damage may occur before the jammer is identified and the null is formed.

The present disclosure provides a radiating element, such as a Balanced Antipodal Tapered Slot Antenna (BAVA) radiating element (ex.—a BAVA antenna element, a BAVA antenna, a BAVA), having embedded circuitry which includes an integrated filter and functions as a port mismatch circuit for protecting a communication system implementing the radiating element from jammers. The embedded circuitry of the radiating element of the present disclosure may provide a dynamically adjustable filter and/or a port mismatch circuit at the radiating element level which allows for center frequency tuning, provides selectivity and/or acts as an adaptive first line of defense layer for protecting sensitive radio and digital signal processing (DSP) physical layers of the communication system.

Figure 1:
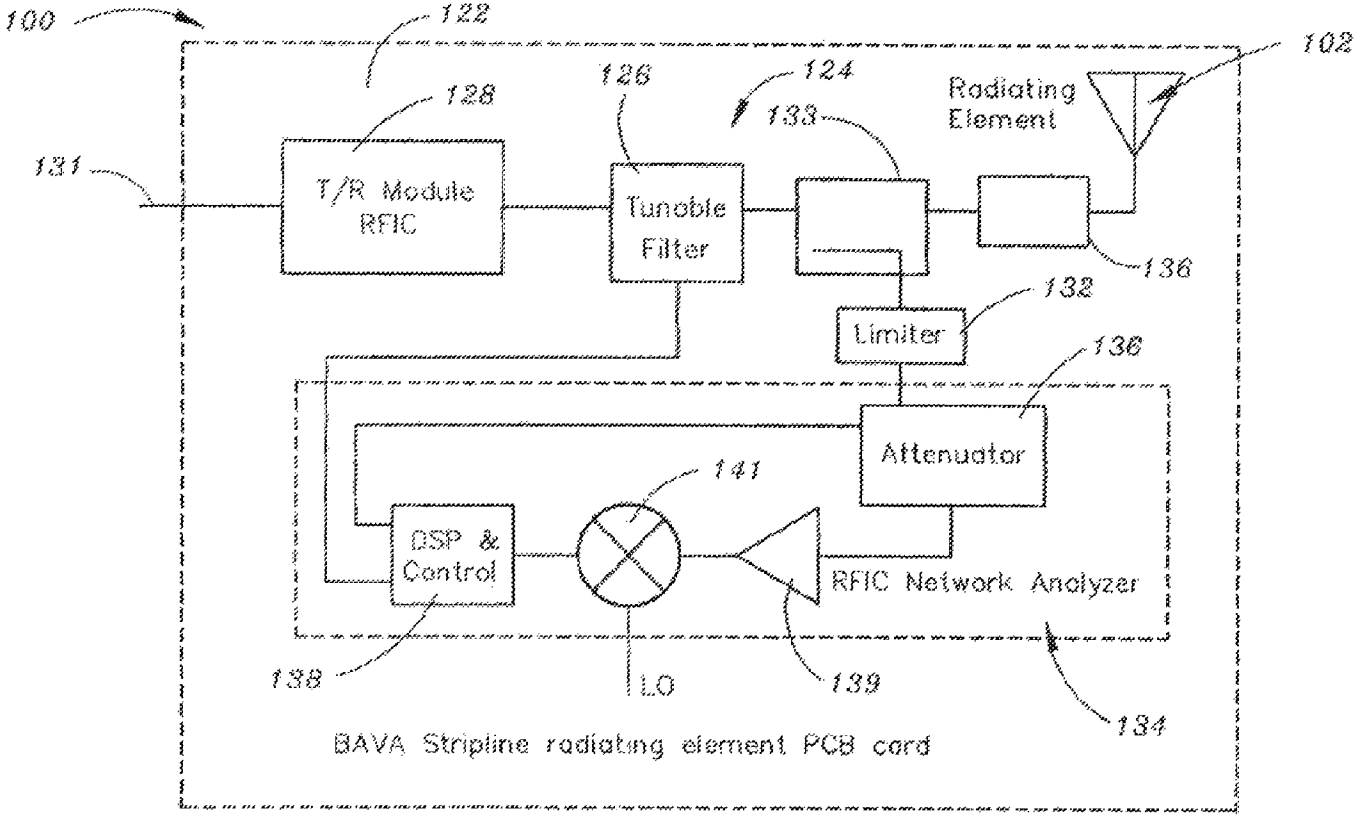
FIG. 1 is a block diagram schematic of a radiating element assembly in which a filter is connected to (ex.—generally located at) an input port of a feed structure of a radiating element of the radiating element assembly in accordance with an exemplary embodiment of the present disclosure.

Referring to FIG. 1, a radiating element assembly (ex.—a cognitive radiating element assembly, a BAVA radiating element assembly) in accordance with an exemplary embodiment of the present disclosure is shown. In an embodiment of the present disclosure, the radiating element assembly 100 may include a radiating element 102. In exemplary embodiments of the present disclosure, the radiating element 102 may be modular. In further embodiments, the radiating element 102 may be a BAVA radiating element (ex.—a BAVA; a BAVA antenna, a BAVA antenna element).

Figure 2:
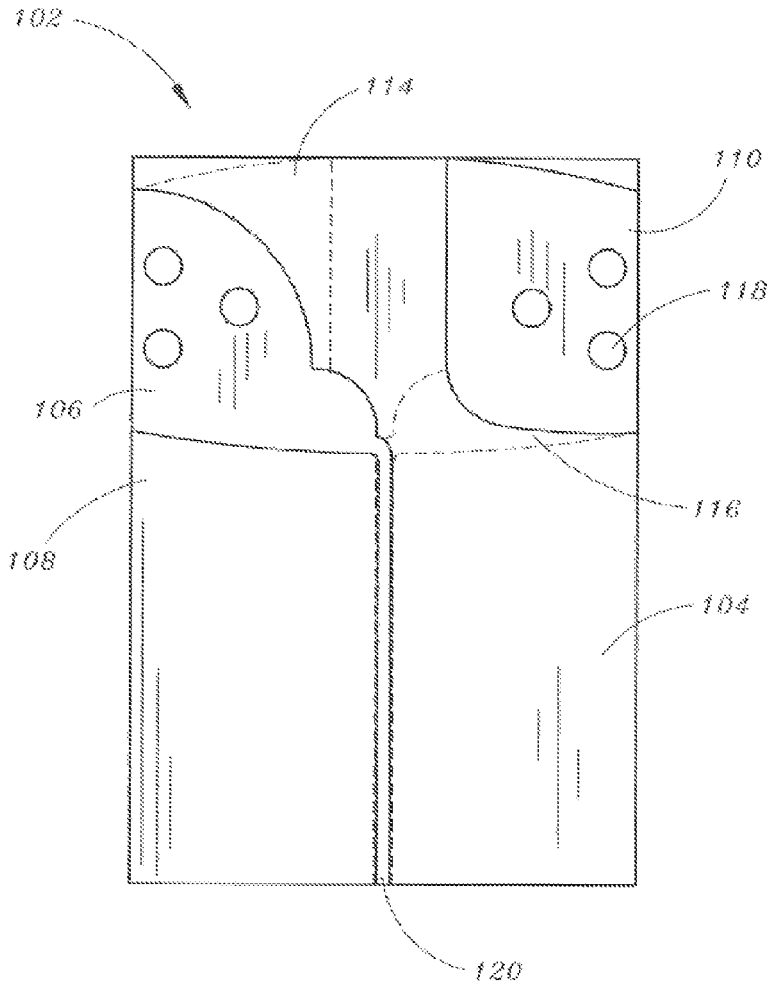
FIG. 2 is a view of a BAVA radiating element, for use in a radiating element assembly in accordance with a further exemplary embodiment of the present disclosure.

In exemplary embodiments of the present disclosure, the BAVA radiating element 102 (as shown in FIG. 2) may include a substrate (ex.—a dielectric substrate; printed circuit board (PCB)) 104. In further embodiments, the BAVA radiating element 102 may include a first outer conductor 106, the first outer conductor being connected to (ex.—configured upon) a first (ex.—top) external surface 108 of the substrate 104. In an embodiment of the present disclosure, the BAVA 102 may further include a second outer conductor (not shown), the second outer conductor being connected to (ex.—configured upon) a second (ex.—bottom) external surface (not shown) of the substrate 104. In still further embodiments of the present disclosure, the BAVA 102 further includes a third outer conductor 110, the third outer conductor being connected to (ex. —configured upon) the top external surface 108 of the substrate 104. In further embodiments of the present disclosure, the BAVA 102 further includes a fourth outer conductor (not shown), the fourth outer conductor being connected to (ex. —configured upon) the bottom external surface (not shown) of the substrate 104.

In an embodiment of the present disclosure, the BAVA 102 further includes a first embedded conductor 114 and a second embedded conductor 116, the embedded conductors (114, 116) being embedded within the substrate 104. In further embodiments of the present disclosure, the first outer conductor 106, the second embedded conductor 116 and the second outer conductor (not shown) may each be configured with a plurality of vias 118 formed therethrough for allowing the first outer conductor, the second embedded conductor and/or the second outer conductor to be electrically connected to each other. In still further embodiments of the present disclosure, the third outer conductor 110, the first embedded conductor 114 and the fourth outer conductor may each be configured with a plurality of vias 118 formed therethrough for allowing the third outer conductor, the first embedded conductor and/or the fourth outer conductor to be electrically connected to each other. In further embodiments of the present disclosure, the third outer conductor 110, the second embedded conductor 116 and the fourth outer conductor may be formed as additional metallic structures of the BAVA 102. In still further embodiments of the present disclosure, the BAVA 102 may include a plurality of feed structures 120, each configured for providing an electrical feed to at least one of the conductors of the BAVA 102. For example, the BAVA radiating element 102 may be a flared notch antenna emanating from a PCB stripline feed.

The above description is directed to an exemplary embodiment of BAVA 102 which may be implemented in the radiating element assembly 100 of the present disclosure (such as the BAVA 102 shown in FIG. 2) and is not intended to be limiting. The BAVA 102 may be configured in any of a number of various configurations and may be suitable for implementation in the radiating element assembly 100 of the present disclosure. For example, the BAVA 102 may be configured as any one of the various configurations of BAVA disclosed in U.S. patent application Ser. No. 12/893,585 entitled: "Ultra Wide Band Balanced Antipodal Tapered Slot Antenna And Array With Edge Treatment", filed on Sep. 29, 2010; and in U.S. patent application Ser. No. 12/893,648 entitled: "Phase Center Coincident, Dual-Polarization BAVA Radiating Elements For UWB ESA Apertures", filed on Sep. 29, 2010, both of which are hereby incorporated by reference.

In an embodiment of the present disclosure, the BAVA 102 may be connected to a card (ex.—a printed circuit board (PCB) card; a stripline radiating element PCB card) 122. In further embodiments of the present disclosure, the BAVA 102 may be connected, via its feed structure(s) 120, to circuitry 124 of the radiating element assembly 100. The circuitry 124 may be connected to (ex.—embedded within) the stripline PCB card 122 for providing a configurable/reconfigurable circuit.

Figure 3:
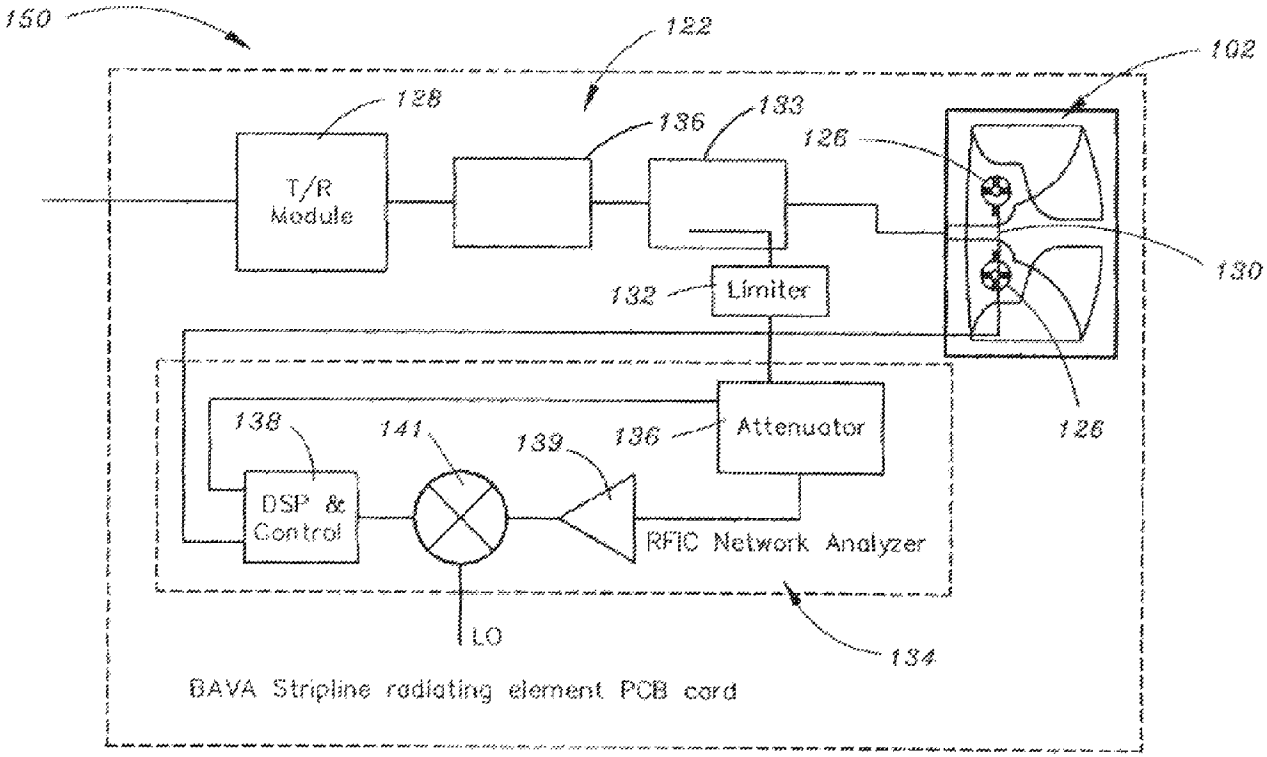
FIG. 3 is a block diagram schematic of a radiating element assembly in which filters are integrated within a radiating element of the radiating element assembly and implemented in a radiation throat area of the radiating element in accordance with a further exemplary embodiment of the present disclosure.

In exemplary embodiments of the present disclosure, the circuitry 124 may include one or more filters (ex.—integrated filter(s)) 126. For example, each filter 126 may be an electronic circuit which performs signal processing functions, specifically to remove unwanted frequency components from the signal, to enhance wanted ones, or both. In an embodiment of the present disclosure, as shown in FIG. 1, the filter 126 may be connected to a feed structure 120 (ex.—a stripline input port) of the BAVA 102. In an alternative embodiment of the present disclosure, as shown in FIG. 3, a radiating element assembly 150 may be constructed in a similar manner to the radiating element assembly described above, except that the filter(s) 126 may be integrated within the BAVA 102. For instance, the filter(s) 126 may be implemented in a flared notch (ex.—throat region; radiation throat area; flare) 130 of the BAVA 102.

In an embodiment of the present disclosure, the filter 126 may be a tunable filter. In further embodiments of the present disclosure, the filter 126 may be switched into and out of the BAVA 102. In still further embodiments of the present disclosure, the filter 126 may implement a lowpass, bandpass, or notch (ex.—bandstop) topology. In further embodiments, the filter 126 may implement RF switches (ex.—microelectromechanical systems (MEMS), PIN, etc.) for coarse center frequency tuning of the filter 126. For instance, a number of currently available RF MEMS switches may be configured for handing multiple watts (W) of hot RF switching. In still further embodiments, the filter 126 may implement Silicon Carbide (SiC) diodes or PIN diodes as alternative, high-power RF switching devices. In further embodiments, the filter 126 may implement high power varactors (ex.—Gallium Nitride (GaN) varactors; SiC varactors) for providing pure analog tuning.

In still further embodiments, the filter 126 may be constructed via a fabrication process which: allows the filter 126 (including its capacitors and inductors) to have very small dimensions relative to the BAVA radiating element 102 (ex.—to be miniature lumped inductors, capacitors and/or filter(s)), such as for the Ultra High Frequency (UHF) to twenty Gigahertz or greater (20+ GHz) frequency bands; allows the filter 126 to have very high quality (Q) factor inductors and capacitors; allows the filter 126 to be high performance (ex.—to have high power handling capability; high selectivity; low loss; etc.); and/or allows the filter 126 to be integrated within the BAVA 102 (ex.—allows the filter 126 to be implemented as a BAVA element-level, tunable filter 126 (to be readily integrated into the BAVA 102) such as shown in FIG. 3). For instance, the filter 126 may be constructed via a fabrication (Z-fab) process, a Polystrata™ microfabrication process, may be miniaturized, and/or may include capacitor(s) such as described in U.S. patent application Ser. No. 12/856,748 entitled: "Microfabricated RF Capacitor", filed on Aug. 16, 2010, which is hereby incorporated by reference. High Q lumped inductors are also realizable in Z-fab technology.

In exemplary embodiments of the present disclosure, the circuitry 124 may further include a transceiver (T/R) module (ex.—a RF integrated circuit (RFIC) communication (COMM) system T/R module; an Electronic Attack (EA) T/R module; or radar T/R module) 128. The T/R module 128 may be connected to input/output (I/O) line(s) 131 via which I/Os may be provided to and from the assembly 100. The T/R module 128 may further be connected to (ex.—communicatively coupled with) the filter 126.

In an embodiment of the present disclosure, the circuitry 124 may further include a limiter 132. The limiter 132 may be configured for being connected to (ex.—communicatively coupled with) the BAVA 102 such as via a RF coupler 133 as shown). The limiter 132 may be a circuit that allows signals below a specified input power to pass unaffected, while attenuating the peaks of stronger signals which exceed the specified input power. In further embodiments, the limiter 132 may be a PIN diode limiter and may serve as an RF clamp.

In exemplary embodiments of the present disclosure, the circuitry 124 may further include a RF integrated circuit (RFIC) network analyzer (ICNA) (ex.—spectrum analyzer) 134. The ICNA 134 may be connected to (ex.—communicatively coupled with) the filter 126. Further, the ICNA 134 may be connected to (ex.—communicatively coupled with) the limiter 132. In further embodiments, the ICNA 134 may include an attenuator (ex.—an RF attenuator; an RFIC attenuator) 136. The attenuator 136 may be an electronic device that reduces the amplitude or power of a signal without appreciably distorting its waveform. Further, the attenuator 136 may be configured for protecting the transceiver module 128 and the ICNA 134. In still further embodiments of the present disclosure, the ICNA 134 may further include a digital signal processing (DSP) and control module 138. The DSP module 138 may be connected to (ex.—communicatively coupled with) the attenuator 136. The DSP module 138 may be a specialized microprocessor with an architecture optimized for the fast operational needs of digital signal processing. In further embodiments, the ICNA 134 may further include an amplifier 139 and/or a mixer 141, the amplifier 139 and/or mixer 141 being connected to the DSP module 138 and attenuator 136

In an embodiment of the present disclosure, the ICNA 134 includes a memory which implements a look-up table that controls: the limiter 132 (if the limiter is not self-biased; the RF attenuator 136; RF switches of the circuitry 124; and tuning of the Z-fab filter 126. In further embodiments, the ICNA 134 may be configured for reducing jammer signal strength to: protect an RF front end (RF transceiver front end circuit) of a cognitive communication radio system in which the radiating element assembly 100 may be implemented; be within a dynamic range of an Analog-to-Digital (A/D) convertor; and prevent modem saturation. In further embodiments of the present disclosure, the memory of the ICNA 134 is configured for setting excitations of the T/R module 128 that are required for beam steering and spatial nulling. In still further embodiments of the present disclosure, the ICNA 134 may be configured for sensing a jammer environment. In further embodiments, the ICNA 134 may be configured for providing dynamic control of the tunable filter 126 and attenuator 136. The ICNA 134 may be miniature, may have high Q inductors and capacitors, and/or may have high power handling capability for allowing the ICNA 134 to be compatible with the BAVA element-level Z-fab tunable filter 126. In still further embodiments, the radiating element assemblies (100, 150) may implement a second attenuator 136. For example, in the assembly 100 shown in FIG. 1, the second attenuator 136 may be connected between the RF coupler 133 and the BAVA 102, while in the assembly 150 shown in FIG. 3, the second attenuator 136 may be connected between the T/R module 128 and the RF coupler 133.

In exemplary embodiments of the present disclosure, the radiating element assembly 100 may be a 10:1 compact BAVA radiating element assembly with dimensions compatible with integration of the Z-fab filter(s) 126, the ICNA 134, the limiter 132 and the attenuator 136. In further embodiments, the radiating element assembly 100 may be miniature, UWB and implemented as part of (ex.—as a unit cell of) an active electronically scanned array (AESA) and/or an electrically large array. In an embodiment of the present disclosure, other radiating elements 102 may be implemented in the assembly 100 other than BAVA radiating elements 102. For example, the assembly 100 may implement any one or more of the following radiating elements: end-fire; planar transverse electromagnetic (TEM) horns (ex.—Vivaldi, Bunny Ears, etc.); broad side radiating elements. Further, when the assembly 100 implements broad side radiating elements, the filters 126, the T/R module 128, the (DSP) and control module 138, the mixer 141, the amplifier 139, the ICNA 134, the attenuators 136, and the limiter 132 may reside directly in or below layers of the radiating ground plane.

In an embodiment of the present disclosure, the BAVA radiating element assembly (ex.—cognitive BAVA radiating element assembly) 100 may retain all features of a baseline passive BAVA. For instance, the BAVA radiating element assembly 100 may be modular, with no contiguous egg crate grounds needed. Further, the BAVA radiating element assembly 100 may have one or more of the following characteristics: short element height; low cross-polarization; and UWB functionality (when the tunable Z-fab filter 126 is in an off state). As mentioned, the BAVA radiating element assembly 100 may be implemented in a cognitive communication radio system. Further, the BAVA radiating element assembly 100 may be configured for protecting the cognitive communication radio system's RF front end to enable friend-to-friend communication for the system in a high field strength jammer electromagnetic environment.

Figure 4:
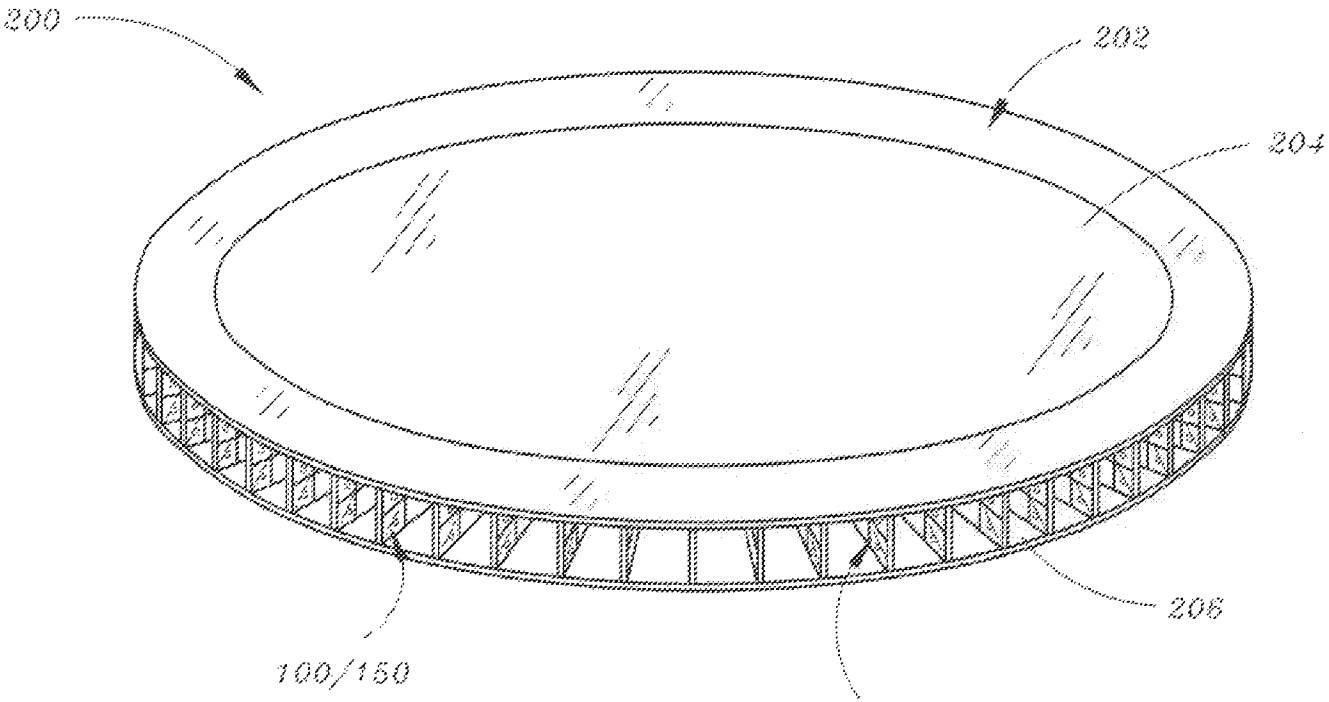
FIG. 4 is a view of a BAVA array implementing a plurality of radiating element assemblies which are connected between plates of a parallel plate waveguide, the array being configured as a circular array in accordance with a exemplary embodiment of the present disclosure.

As mentioned above, in exemplary embodiments of the present disclosure, the BAVA radiating element assembly 100 may be implemented as part of (ex.—as a unit cell of) an AESA (ex.—an electrically large array; a UWB BAVA array). A large number of BAVA radiating elements may be required in an Electronically Scanned Array (ESA) aperture. The total jammer power density rejection of the array may be a multiple of the number of elements multiplied by the power handling capability of the cognitive BAVA unit cell. In an embodiment of the present disclosure, a plurality of BAVA radiating element assemblies 100 may be implemented in an array (ex.—a circular array) 200, as shown in FIG. 4. For instance, the array 200 may include seventy-two BAVA radiating element assemblies 100. Approximately one-quarter of the array 200 may be illuminated by a jammer for a given direction when the array 200 is configured in a directional mode. For a Z-fab filter capable of handling 100 W, the total power density that the array 200 may reject may be approximately 72*100*0.33=approximately 2.4 Kilowatts (KW). In further embodiments, the array 200 may be configured for service/implementation in a specific mission. For example, an arbitrary number of elements or subarrays (ex.—groups of elements) of the array 200 may be excited in an arbitrary location to synthetically form a radiation pattern for direction finding applications.

In an embodiment of the present disclosure, the array 200 shown in FIG. 4 may be configured for being a multi-function, multi-beam circular array (MCA) of BAVA radiating element assemblies 100 (ex.—a MCA-BAVA array). In further embodiments, the array 200 may be configured for providing multi-band (ex.—Ultra High Frequency (UHF), L, S and C bands; 6:1 instantaneous bandwidth) communication through a single compact aperture (ex.—a parallel plate waveguide) 202 for lowering the radar cross section (RCS) of size-constrained Unmanned Aerial Vehicle (UAV) platforms. In still further embodiments, the array 200 may be configured for leveraging the unique properties of electromagnetic image theory to employ mutual coupling of BAVA elements 100 in an array environment, thereby enabling wideband operation and size reduction of the radiating element assemblies 100. In further embodiments of the present disclosure, metamaterial topologies may be employed in the design of the BAVA radiating elements 100 to maximize scan volume. As mentioned above, the aperture 202 may be configured as a parallel plate waveguide having a first conducting surface (ex.—a top conducting surface; a first plate) 204 and a second conducting surface (ex.—a bottom conducting surface; a second plate) 206, the second plate 206 being in a parallel orientation relative to the first plate 204. For instance, the parallel plate waveguide 202 may be two feet in diameter. Further, the radiating element assemblies 100 may be configured between the two conducting surfaces (204, 206) (and connected to the two conducting surfaces (204, 206)) in a circular arrangement. In still further embodiments, the array 200 may be configured for providing omni-directional beams and/or directional beams. In further embodiments, the aperture 202 may be a low-profile aperture 202, such that the radiating element assemblies 100 connected between the plates (204, 206) of the aperture 202 may be one inch in height.

Figure 5:
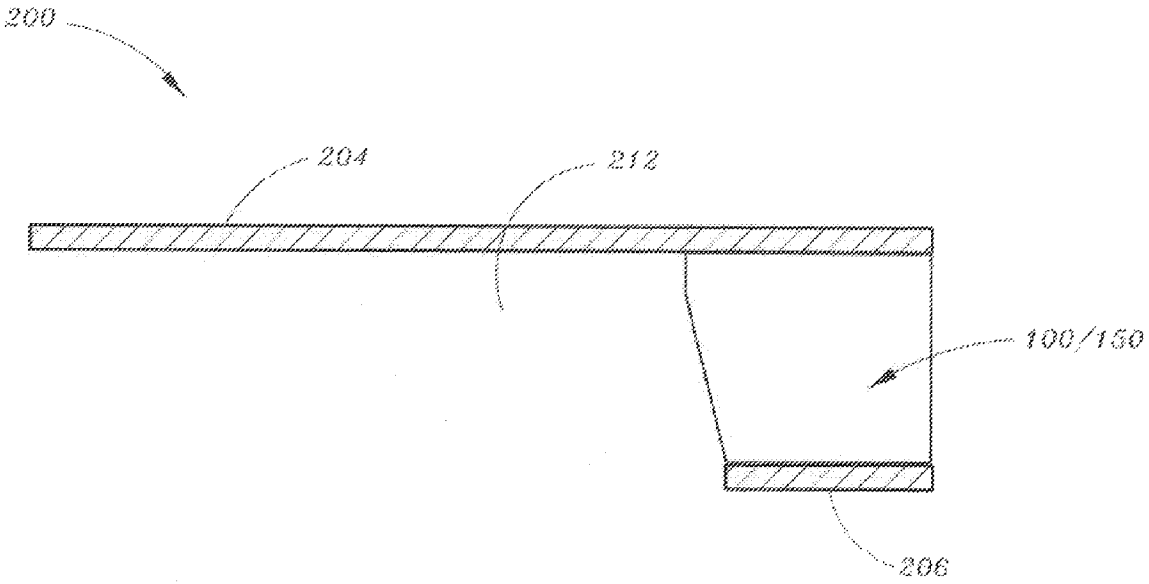
FIG. 5 is a view of a BAVA array being implemented on-board a mobile platform (ex.—helicopter) in accordance with an exemplary embodiment of the present disclosure.
Figure 6:
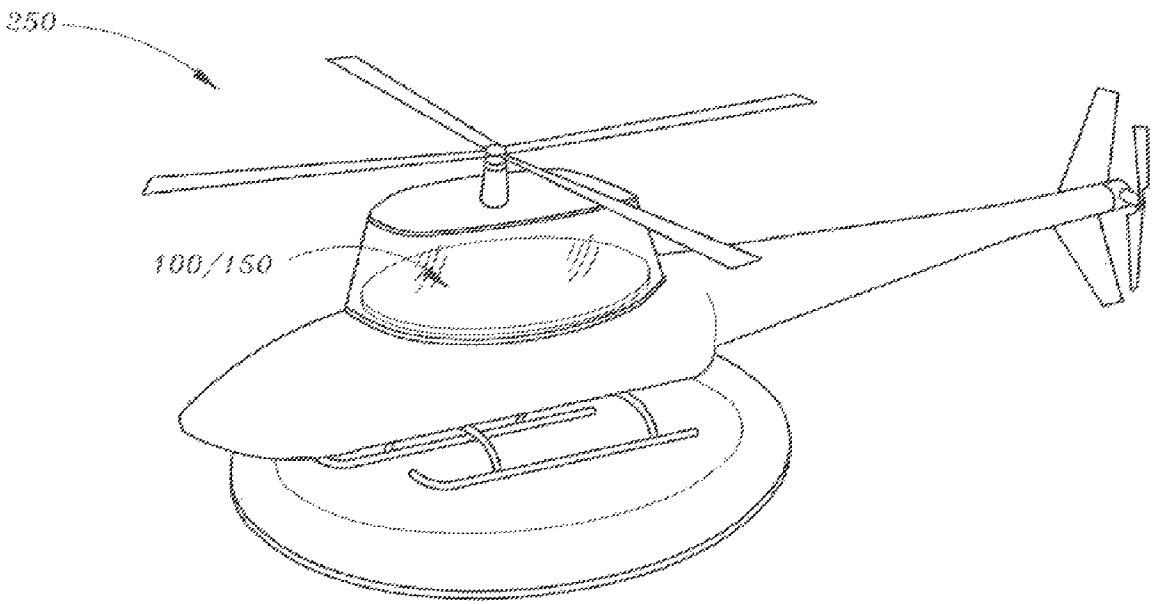

In exemplary embodiments, as shown in FIG. 5, one of the plates (ex.—one of the parallel plate walls) 206 is shorter in length than the other parallel plate wall 204. For instance, the shorter plate 206 may be the same length as the radiating element assemblies 100. For example, the shorter plate 206 may extend a same distance from the outer edges 210 of the aperture 202 towards an interior space/recess/free space 212 which is centrally located between (ex.—formed by) the two plates (204, 206) of the aperture 202. Further, as mentioned above, the radiating element assemblies 100 implemented between the parallel plate walls (204, 206) of the aperture 202 may be short radiating element assemblies (ex.—one inch in height). In further embodiments of the present disclosure, the radiating element assemblies 100 radiate electromagnetic energy into the free space 212. In still further embodiments, a portion of the free space 212 may be configured for being populated with back-end electronics, feed-related electronics and/or circuitry of the array 200. In further embodiments of the present disclosure, the plates (204, 206) of the aperture 202 may be connected to a ground plane 214, as shown in FIG. 5. In still further embodiments, the aperture 202 may be integrated within a skin of a platform 250, such as a UAV, an aircraft, a spacecraft or the like, as shown in FIG. 6.

Typically, because of truncation effects and mutual coupling, it has been difficult in the past to develop antenna arrays which have a small footprint and operate over a wide bandwidth. Previous attempts at achieving wideband operation have involved implementing multiple, narrow band antennas. However, implementing these multiple, narrow band antennas does not allow for beam shaping, beam steering and/or nulling. Further, the mutual coupling had caused interference between the antennas with no practical way to mitigate it. In embodiments disclosed herein, the array 200, by implementing a parallel plate waveguide 202 along with a circular array of BAVA radiating element assemblies 100, may provide broad bandwidth operation via a low profile aperture 202. For instance, the array 200 of the embodiments of the present disclosure may support operation across multiple frequency bands, including the potential to operate with multiple simultaneous transmissions/receptions for the emerging multiple RF channel/band/mode networking waveforms, such as: Quint networking technology (QNT) with operation in the L and C bands; Advanced Tactical Data Link (ATDL) with projected operation in L, S and C bands; and Joint Airborne Layered Network (JALN) capability with potential operation in the S and C bands. Still further, the embodiments of the array 200 of the present disclosure may allow for beam shaping (ex.—one-dimensional scanning, beamwidth and sidelobe levels control) via various classical array excitations.

In further embodiments of the present disclosure, frequency selective surfaces (FSS) may be added to the array (ex.—the MCA-BAVA array) 200 for promoting polarization agility. Other necessary electronics may be added to or connected to the array 200 for enabling mounting of the array 200 on-board various platforms (ex.—UAV platforms; naval platforms; aircraft; spacecraft; etc.). In further embodiments, if two-dimensional (2-D) scanning is desired, the array 200 may be extended from a circular to a cylindrical array. Progressive phase shifting and amplitude weight may be used to scan a main-beam to a specific direction. In still further embodiments, the array may be formed as a planar or spherical array of BAVA elements.

In exemplary embodiments of the present disclosure, the array 200, by implementing a single aperture 202, provides a replacement solution for implementing multiple narrow band antennas (ex.—UHF, L, S and C) having a single wideband aperture, because the array 200 of the present disclosure may simultaneously operate between 830 Megahertz (MHz) to 5 Gigahertz (GHz) at multiple modes of operation (ex.—directional mode and omni-directional mode). In further embodiments of the present disclosure, the array 200 of the present disclosure allows for reduced antenna count and reduced antenna size, while still providing wideband functionality (ex.—UHF; L-band; C-band; and/or S-band). In still further embodiments, the array 200 may experience minimal feed loss and may lower the amount of reflections produced compared to arrays which implement multiple, bulky, narrowband antennas. In further embodiments, the parallel plate waveguide 202 may be formed as a cylindrically-shaped structure. This may enable multiple elements in elevation, which may allow: a) narrow beam width in elevation; and b) the ability to have a two-dimensional (2-D) ESA which scans in azimuth and elevation.

In embodiments of the present disclosure, the array 200 promotes a lower radar signature than currently available wideband arrays, while maximizing connectivity and enhancing stealth. Further, the array 200 of the present disclosure enables better protection from jamming relative to currently available wideband arrays. For instance, the array 200 provides anti-jamming (NJ) performance for a demanding electronic warfare (EW) jammer environment. In further embodiments, the array 200, which may be implemented in cognitive communication radio systems, may enable more flexibility for those radio systems. As mentioned above, the array 200 may be configured for providing both omni-directional and directional modes of operation. Multi-beam operation may occur when appropriate feed circuitry is utilized with the array 200. The array 200 may synthesize an array pattern which allows for spatial nulling, thereby promoting increased resistance to jamming for the system within which the array 200 is implemented.

In exemplary embodiments, the array 200 is scalable for meeting future frequency needs. For example, the MCA-BAVA array 200 may be versatile (ex.—scalable) over a wide frequency range and may be upgradeable for additional bands via vertical stacking of multiple circular arrays 200 on top of each other. For instance, X, $K_u$, K, $K_a$ and Q bands (4:1 bandwidth) may be added by stacking further arrays 200 vertically, starting from low frequency apertures to high frequency apertures. In further embodiments, the array 200 may support rapid switching between omni- and directional modes, which allows for adding of directional capability to existing omni-only waveforms, such as: Link-16, tactical targeting network technology (TTNT), wideband networking waveform (WNW), soldier radio waveform (SRW), common range integrated instrumentation system (CRIIS) and critical data link (CDL). Thus, the array 200 may improve link performance without having to upgrade all nodes in a network to operate in a directional fashion.

In alternative embodiments of the present disclosure, the array 200 may be a linear planar array, such that the plurality of radiating element assemblies 100 of the array 200 may be configured on a standard stripline printed wiring board. In such alternative embodiments, each of the elements (ex.—radiating element assemblies) of the array 200 may require a limiter, attenuators, and/or tunable Z-fab filter at the element level. Further, in such alternative embodiments, an ICNA and/or T/R module may be multi-channel and implemented at a sub-array level rather than at the element level. The basic cognitive radiating elements described above and illustrated in FIGS. 1-3 may be applicable, more generally, to ESA architectures such as: linear array one-dimensional (1-D) ESA, planar 1-D ESA, 2-D planar ESA, cylindrical 1-D and 2-D ESA and any arbitrarily double curved 1-D and 2-D ESA.

In further embodiments, the array 200 may be implemented in: multi-band networks; multi-mode (directional and/or omni) networks; multi-radio networks; Air Traffic Control Communication Navigation and Surveillance (ATC CNS) systems; Integrated Comm/Electronic Warfare (EW) systems; EW in a box systems; and/or EW Direction Finding (DF) systems that can operate in the presence of a jamming signal.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A radiating element assembly, comprising:

a radiating element, the radiating element including a substrate, the radiating element configured for radiating electromagnetic energy; and circuitry, the circuitry being connected to the radiating element, the circuitry including a filter, a transceiver module, a limiter, an RF coupler, an attenuator and a RF integrated circuit network analyzer (ICNA), the filter configured for being tuned to a radio frequency (RF), the transceiver module being connected to the filter and to an input/output line, the limiter configured for being connected to the radiating element via the RF coupler, the ICNA configured for being connected to the limiter, wherein the radiating element and circuitry are connected to a circuit card, the filter configured for being one of: connected to the radiating element at an input port of a feed structure of the radiating element or integrated within the substrate at a radiation throat area of the radiating element.

2. A radiating element assembly as claimed in claim 1, wherein the radiating element is a Balanced Antipodal Vivaldi Antenna (BAVA).

3. A radiating element assembly as claimed in claim 1, wherein the radiating element is modular.

4. A radiating element assembly as claimed in claim 1, wherein the ICNA includes an ICNA attenuator.

5. A radiating element assembly as claimed in claim 4, wherein the ICNA includes a digital signal processing and control module.

6. A radiating element assembly as claimed in claim 5, wherein the ICNA includes an amplifier.

7. A radiating element assembly as claimed in claim 6, wherein the ICNA includes a mixer.

8. A radiating element assembly, comprising:

a Balanced Antipodal Vivaldi Antenna (BAVA) radiating element, the BAVA radiating element including a substrate, the BAVA radiating element configured for radiating electromagnetic energy; and circuitry, the circuitry being connected to the BAVA radiating element, the circuitry including at least one filter, a transceiver module, a limiter, an RF coupler, an attenuator and a RF integrated circuit network analyzer (ICNA), the at least one filter configured for being tuned to a radio frequency (RF), the transceiver module being connected to the filter and to an input/output line, the limiter configured for being connected to the radiating element via the RF coupler, the ICNA configured for being connected to the limiter, wherein the BAVA radiating element and circuitry are connected to a printed circuit board card, the at least one filter being integrated within the substrate at a radiation throat area of the BAVA radiating element.

9. A radiating element assembly as claimed in claim 8, wherein the radiating element is modular.

10. A radiating element assembly as claimed in claim 8, wherein the ICNA includes an ICNA attenuator.

11. A radiating element assembly as claimed in claim 8, wherein the ICNA includes a digital signal processing and control module.

12. A radiating element assembly as claimed in claim 8, wherein the ICNA includes an amplifier.

13. A radiating element assembly as claimed in claim 8, wherein the ICNA includes a mixer.

* * * * *